United States Patent [19]

Williams, Jr.

[11] 4,080,975

[45] Mar. 28, 1978

[54] HEATED AND AIR INJECTED TANK FOR PARTS CLEANER

[76] Inventor: Samuel R. H. Williams, Jr., P.O. Box 171, Wilson, N.C. 27893

[21] Appl. No.: 748,817

[22] Filed: Dec. 9, 1976

[51] Int. Cl.[2] ..... B08B 3/10

[52] U.S. Cl. ..... 134/94; 134/105; 134/110

[58] Field of Search ..... 134/94, 102, 105, 110, 134/111

[56] References Cited

U.S. PATENT DOCUMENTS

| | | | |
|---|---|---|---|
| 1,783,194 | 12/1930 | McConnell et al. | 134/94 |
| 3,291,025 | 12/1966 | Ross et al. | 134/94 |
| 3,613,700 | 10/1971 | Werth et al. | 134/105 X |

FOREIGN PATENT DOCUMENTS

| | | | |
|---|---|---|---|
| 454,525 | 6/1968 | Switzerland | 134/94 |

*Primary Examiner*—Robert L. Bleutge

*Attorney, Agent, or Firm*—Clarence A. O'Brien; Harvey B. Jacobson

[57] ABSTRACT

An upwardly opening tank including peripherally extending upstanding side walls interconnected at their lower marginal portions by a bottom wall extending and secured therebetween is provided. The tank may have a cleaning liquid disposed therein to a predetermined level and includes heater structure in a lower portion thereof below the aforementioned level. A foraminous horizontal baffle is supported within the tank closely below the heater and a multi-branched tubular air manifold is supported horizontally in the tank above the baffle and below the liquid level. The manifold includes upwardly opening air outlets therein and includes an inlet for connection with a supply of air under pressure. Further, an upwardly opening receptacle including a foraminated bottom wall is removably supported in the tank with the bottom wall of the receptacle spaced above the manifold.

4 Claims, 5 Drawing Figures

HEATED AND AIR INJECTED TANK FOR PARTS CLEANER

BACKGROUND OF THE INVENTION

Various forms of parts cleaning tanks containing cleaning fluid have been heretofore provided. Some of these tanks include heating elements for heating the cleaning fluid and other prior tanks include structure for discharging air upwardly through the cleaning liquid within the tank. However, few cleaning tanks include both heating elements and air injection structure and those cleaning tanks provided with both heating elements and air injection structure are not constructed in a manner whereby a predetermined circulation of cleaning fluid is established within the tank by the injection of air upwardly through the fluid and whereby a lower sump portion is provided in the lowest portion of the tank for precipitation of dirt particles from the cleaning liquid with the sump being at least partially isolated relative to the remainer of the interior of the tank disposed thereabove in a manner to reduce the turbulance of cleaning liquid within the sump area the for promotion of the desired precipitation of dirt particles from the liquid disposed within the tank.

Examples of cleaning tanks including some of the general structural and operational features of the instant invention are disclosed in U.S. Pat. Nos. 2,115,622, 2,151,354, 2,559,472, 2,597,931 and 2,720,210.

BRIEF DESCRIPTION OF THE INVENTION

The parts cleaning tank of the instant invention includes structure for removably supporting an upwardly opening receptacle provided with a foraminated bottom within the tank at an elevation such that the bottom of the receptacle is disposed below the level of cleaning liquid in the tank. The tank further includes a heater disposed below the predetermined liquid level therein whereby the cleaning liquid may be heated and an air manifold is supported within the tank at an elevation to be spaced at least slightly below the bottom of the aforementioned receptacle and the manifold is operative to discharge jets of air upwardly through the cleaning liquid disposed within the tank. Further, the lower end of the tank is provided with a sump portion over which a foraminated baffle extends and the baffle is spaced below the manifold and serves to substantially isolate the sump portion of the bottom of the tank below the baffle from the interior of the tank above the baffle and below the liquid level therein in order to facilitate and enhance the precipitation of dirt from the cleaning liquid within the sump below the foraminated baffle.

The main object of this invention is to provide a parts cleaning tank which will be operative to maintain the cleaning liquid within the tank in a heated condition and which will also be operative to cause a plurality of jets of air to be directed upwardly through the cleaning fluid.

Another object of this invention is to provide an upwardly opening receptacle for removable positioning within the tank and including a foraminated bottom wall spaced slightly above the manifold whereby parts to be cleaned may be supported with the receptacle and subject to heated cleaning fluid being agitated by the jets of air being discharged upwardly therethrough.

Yet another object of this invention is to provide a cleaning tank in accordance with the preceding objects and including a lower sump portion spaced below a horizontal foraminated baffle within the tank whereby the horizontal baffle may function to substantially fully isolate the cleaning liquid within the sump below the baffle against agitation and thereby enhance the precipitation of dirt particles from the cleaning liquid disposed below the baffle.

Another very important object of this invention is to provide a cleaning tank in accordance with the preceding objects and which may be readily utilized by inexperienced persons.

A final object of this invention to be specifically enumerated herein is to provide a parts cleaning tank in accordance with the preceding objects and which will conform to conventional forms of manufacture, be of simple construction and easy to use to as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part thereof, wherein like numerals refer to like parts throughout.

DETAILED DESCRIPTION OF THE INVENTION

Figure 1:
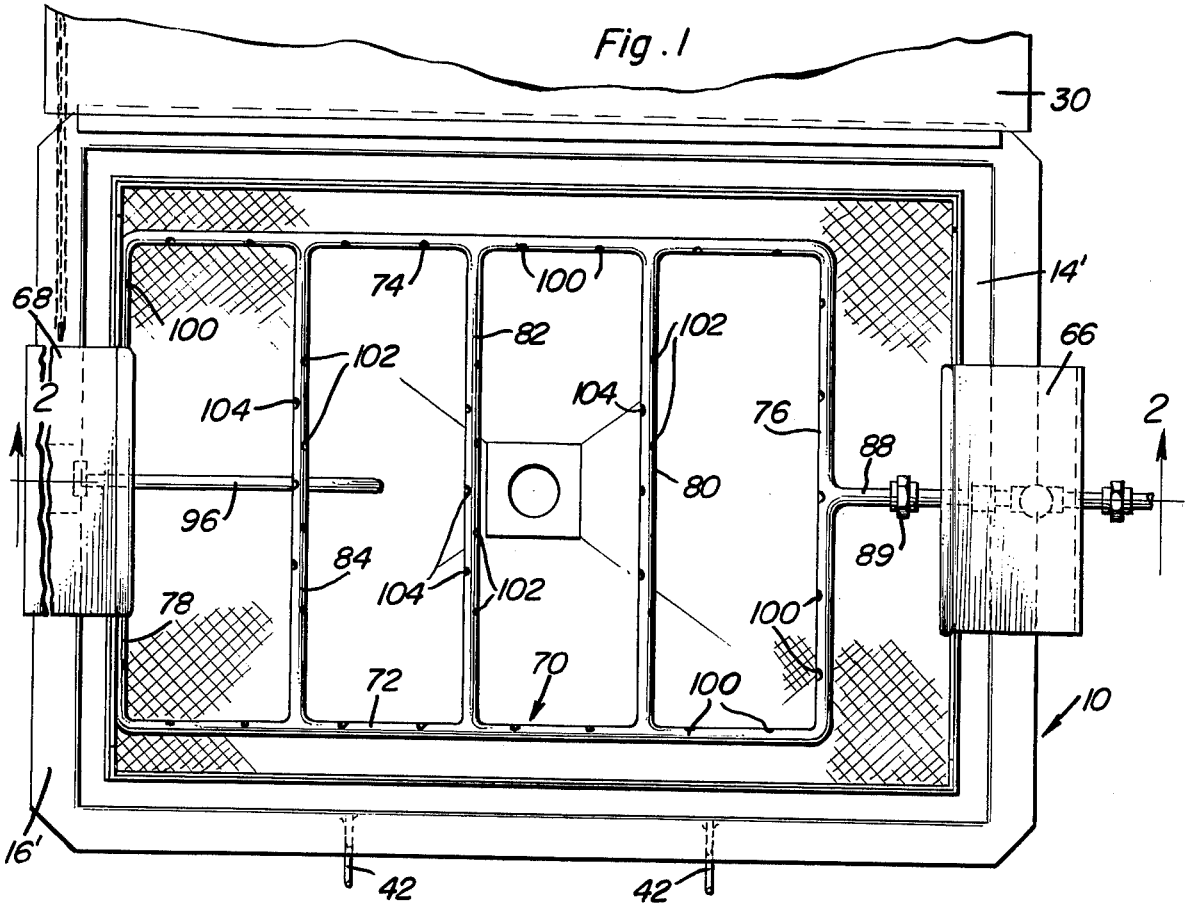
FIG. 1 is a top plan view of the parts cleaning tank of the instant invention with the hinged closure top wall thereof fragmentarily illustrated in an open position.
Figure 2:
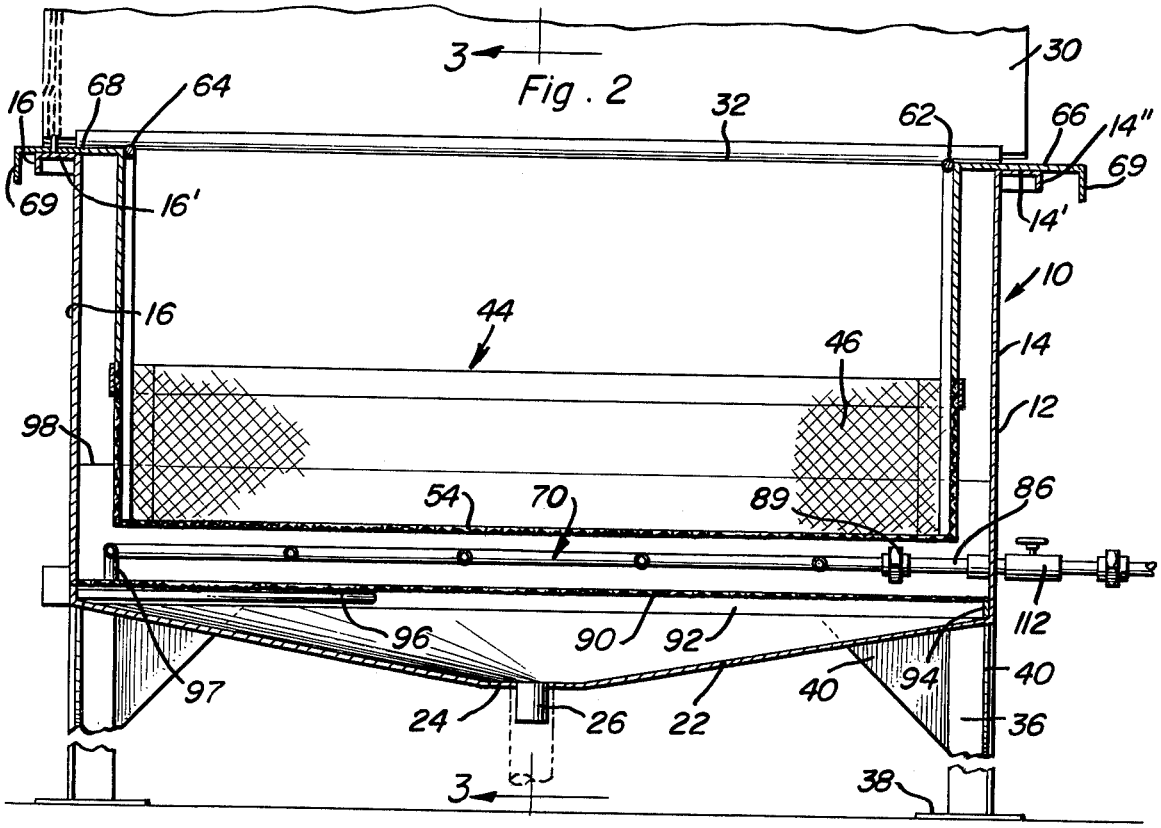
FIG. 2 is a fragmentary vertical sectional view taken substantially upon the plane indicated by the section line 2—2 of FIG. 1.

Referring now more specifically to the drawings, the numeral 10 generally designates the parts cleaning tank of the instant invention. The tank 10 includes an upper tank portion 12 having opposite end walls 14 and 16 interconnected by means of front and rear walls 18 and 20. The lower marginal portions of the walls 14, 16, 18 and 20 are interconnected by means of a bottom wall 22 extending and connected therebetween. The bottom wall 22 includes a central portion 24 downwardly toward which the surrounding portions of the bottom wall 22 are inclined and the portion 22 includes a drain outlet 26 with which a valved drain line 28 may be operatively associated for draining liquid from within the tank portion 12.

The upper marginal portions of the walls 14, 16, 18 and 20 include horizontally outwardly projecting horizontal flanges 14′, 16′, 18′ and 20′ terminating outwardly in downturned flanges 14″, 16″, 18″ and 20″. The flange 20′ has the rear marginal portion of a top or cover panel 30 hingedly supported therefrom by means of hinge assemblies 32 spaced along the flange 20′ and the cover panel 30 may be swung from the rearwardly and upwardly inclined open position thereof illustrated in FIG. 3 to a horizontal position closely overlying the flanges 14′, 16′, 18′ and 20′, a limit chain 34 being connected between the panel 30 and the flange 16' in order to limit swinging movement of the panel 30 to the open position thereof.

Each of the four corner portions of the tank portion 12 includes a depending leg 36 provided with a horizontally enlarged foot 38 at its lower end and each of the legs 36 is braced by means of a pair of triangular gussets 40. Also, the front wall 18 of the tank portion 10 includes a pair of forwardly projecting and upwardly opening hooks 42 whereby a pair of gloves and a wire brush may be conveniently supported for ready use by a person desiring to use the parts cleaner 10.

Figure 3:
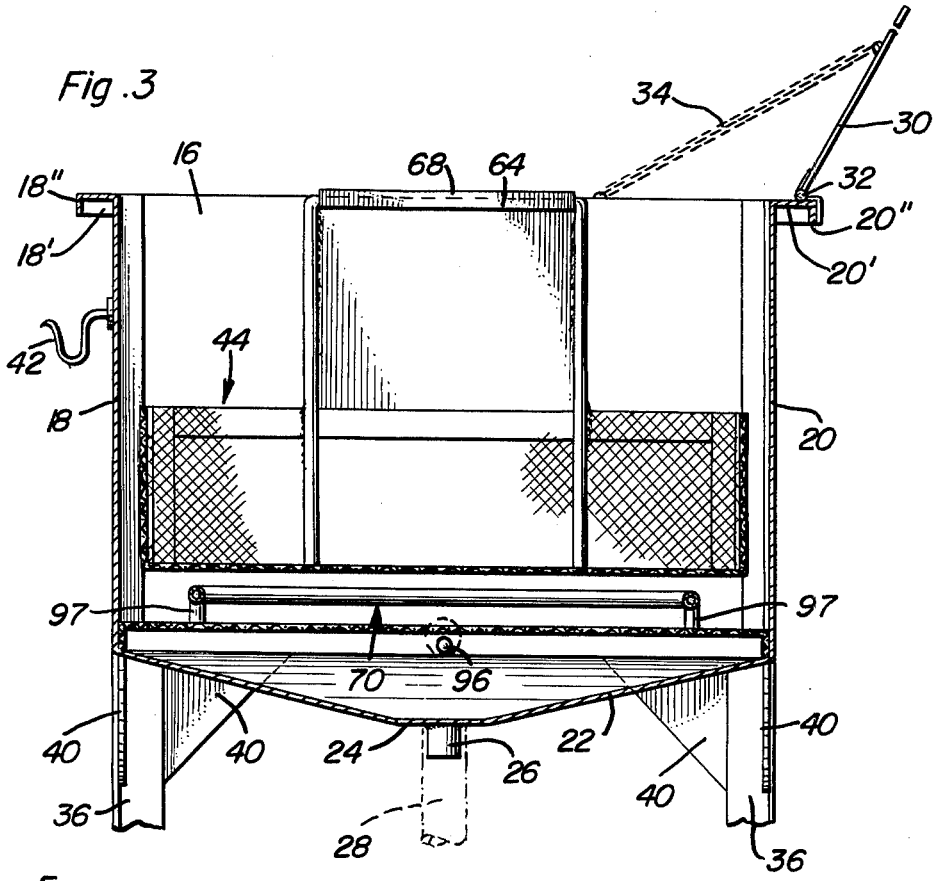
FIG. 3 is a fragmentary vertical section view taken substantially upon the plane indicated by the section line 3—3 of FIG. 2.
Figure 4:
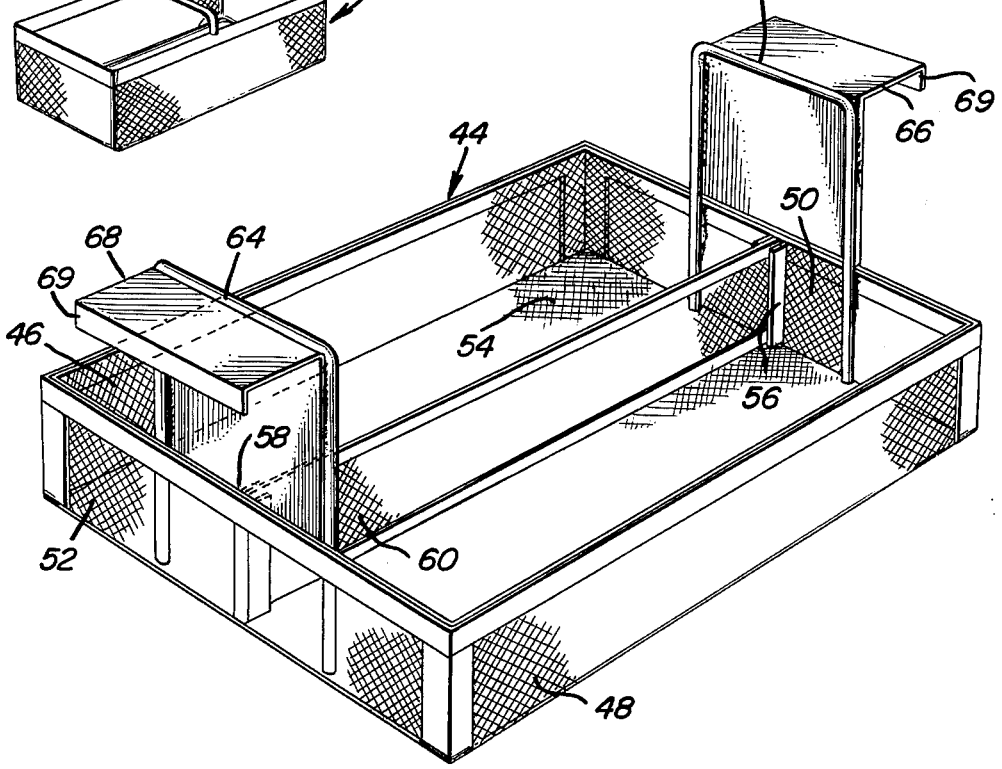
FIG. 4 is a perspective view of the upwardly opening parts receiving receptacle of the instant invention.

With reference now more specifically to FIGS. 1, 3 and 4 of the drawings, there may be seen an upwardly opening receptacle referred to in general by the reference numeral 44. The receptacle 44 includes forminated opposite side walls 46 and 48 interconnected at corresponding ends by means of foraminated end walls 50 and 52 and the lower marginal portions of the walls 46, 48, 50 and 52 are interconnected by means of a foraminated bottom wall 54 extending therebetween. The midportions of the end walls 50 and 52 include inwardly opening upstanding channel members 56 and 58 supported therefrom and the opposite end portions of an edge upstanding partition 60 are removably receivable in the channel members 56 and 58 for supporting the partition 60 in upstanding position extending between the end walls 50 and 52. In addition, the opposite end walls 50 and 52 support the lower ends of a pair of inverted U-shaped members 62 and 64 therefrom and the upper portions of the U-shaped members include outwardly projecting abutment flanges 66 and 68 supported ane extending outwardly from remote sides of the members 62 and 64 and terminating outwardly in downturned flanges 69. The receptacle 44 is snugly receivable downardly into the interior of the tank portion 12 to a position with the flanges 66 and 68 abutted against and supported from the upper surfaces of the longitudinal midportions of the flanges 14' and 16' and projecting outwardly of the latter to define handles. When the receptacle 44 has its abutment flanges 66 and 68 supported from the flanges 14' and 16', the bottom wall 54 of the receptacle 44 is spaced slightly above an air manifold referred to in general by the reference numeral 70 supported in a lower portion of the tank portion 12.

The manifold 70 includes opposite side peripheral portions 72 and 74 interconnected at corresponding ends by means of opposite end peripheral portions 76 and 78. The adjacent ends of the portions 72, 74, 76 and 78 are communicated with each other and a plurality of tubular transverse portions 80, 82 and 84 extend between corresponding portions of the peripheral portions 72 and 74 and are communicated with the interiors thereof. Accordingly, the manifold 70 defines a hollow multi-branched air chamber.

A valved air supply line 86 passes through the lower portion of the end wall 14 in fluid tight sealed engagement therewith and the end peripheral portion 76 of the manifold 70 includes a central air inlet neck 88 is removably sealingly coupled to the discharge end of the air line 86 by means of a pipe union 89. Of course, the inlet end of the line 86 is adapted to be communicated with a suitable source of air under pressure.

The interior of the lower portion of the tank portion 12 includes a horizontal foraminated baffle 90 including downturned opposite side and end peripheral flanges 92 and 94 whose lower marginal edges are abutted against and supported from the corresponding marginal portions of the bottom wall 22. The baffle 90 may be constructed of expanded metal as may be the walls 46, 48, 50 and 52 of the receptacle 44 and an electrical heating element 96 is disposed within the lower portion of the tank portion 12 below the baffle 90.

The end of the manifold 70 remote from the inlet neck 88 thereof is provided with opposite side depending foot portions 97 whose lower ends abut and are supported from corresponding end of the baffle 90 and the tank portion 12 is adapted to have cleaning liquid disposed therein to the level 98 spaced above the manifold 70 and the bottom wall 54 of the receptacle 44 when the latter is supported within the tank portion 12 from the flanges 14' and 16'.

Figure 5:
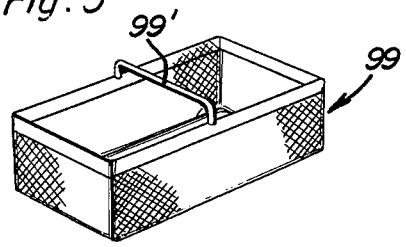
FIG. 5 is a perspective view of a small parts receiver of foraminated construction and which is receivable in one of the two compartments of the main receptacle removably positionable within the tank.

With attention now invited more specifically to FIG. 5 of the drawings, there may be seen a small upwardly opening foraminated container 99 which is receivable in either one of the compartments defined in the interior of the receptacle 44 on opposite sides of the partition 60. The container 99 is also constructed of expanded metal and may be utilized to removably support small parts within either side of the interior of the receptacle 44. Further, the container 99 includes a handle 99'.

With attention now invited more specifically to FIG. 1 of the drawings, it may be seen that each of the portions 72, 74, 76 and 78 of the manifold 70 includes longitudinally spaced openings 100 formed therein which open upwardly in inwardly inclined directions. In addition, the portions 80, 82 and 84 include openings 102 and 104 formed therein at points spaced alternatively therealong and which open upwardly in oppositely inclined directions. Accordingly, when air is supplied under pressure to the manifold 70, jets of air are discharged from the openings 100, 102 and 104 whereby upward jets of compressed air are discharged into the cleaning liquid for agitating the latter and assisting in cleaning of any parts contained within the receptacle 44 and also the container 99. The upwardly and inwardly inclined openings 100 insure that the return flow of liquid down into the bottom of the tank is downwardly along the inner surfaces of the walls 14, 16, 18 and 20 whereby the returning liquid may pass downwardly through the baffle 90 and pass toward the center of the lower portion of the bottom of the tank portion 12 in a non-agitated state to thereby enable and dirt entrained therein to be precipitated therefrom down into the bottom of the sump prior to the liquid being gradually moved upwardly through the baffle 90 as a result of air being discharged upwardly from the manifold 70. The heater 96 may be of the thermostatically controlled type and therefore may maintain the temperature of the liquid within the tank portion 12 substantially constant.

The top cover or panel 30 of the tank portion 12 may be swung to a closed position with or without the receptacle 44 supported within the tank portion.

In operations, parts to be cleaned may be placed within the receptacle 44 and the container 99 within one of the compartments of the receptacle 44 and the latter may then be lowered downwardly into the tank portion 12 for support therein by means of the abutment members 66 and 68 being engaged with the upper surfaces of the flanges 14' and 16'. Then, the liquid within the tank portion 12 being heated by means of the heater 96, the valve 112 in the line or pipe 86 is opened and air is ducted into the manifold 70 under pressure for upward discharge from the openings 100, 102 and 104, Of course, this will cause agitation of the cleaning liquid within the tank portion 12 above the manifold 70 and thus within the receptacle 44, the upper surface of the liquid within the tank portion 12 being elevated considerably as a result of air being entrained within the liquid during the process of being bubbled upwardly through the liquid.

When it becomes necessary to clean the residue of dirt from the hopper bottom of the tank portion 12, the cleaning liquid within the tank portion 12 may be drained therefrom through the outlet 26. In addition, the manifold 70 may be readily removed by uncoupling the union 89 and after the manifold 70 has been removed, the baffle 90 may be readily removed. This, of course, provides free access to the upper surfaces of the bottom wall which may then be cleaned as desired.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, an upwardly opening horizontally elongated rectangular tank including peripherally extending upstanding opposite side and opposite end walls interconnected at their lower marginal portions by means of a bottom wall extending and secured therebetween, said tank being adapted to have a cleaning liquid disposed therein to a predetermined level, heater means in a lower portion below said level operative to heat said liquid, a foraminous horizontal baffle disposed in said tank below said level and above said bottom wall, a multibranched tubular air manifold disposed horizontally in said tank above said baffle and below said level, said manifold including means defining jet-type air outlet openings therefor spaced along the multiple branches of said manifold and operative to discharge jets of air upwardly into the liquid disposed in said tank in response to the interior of said manifold being communicated with a source of air under pressure, and an upwardly opening receptacle including foraminated bottom wall portions, said receptacle and tank including coacting means operative to support said receptacle within said tank with the foraminated bottom wall portions disposed below said level and above said manifold, said manifold being horizontally elongated and including tubular peripherally extending opposite side and opposite end marginal portions and a plurality of laterally spaced generally parallel transverse tubular cross portions extending between and communicating with said tubular opposite side marginal portions intermediate said opposite end marginal portions, said jet-type air outlet openings being spaced along said marginal and cross portions, said air outlet openings spaced along said marginal portions opening upwardly along paths inclined toward the center of the area bounded by said marginlal portions, alternate air outlet openings spaced along said cross portions opening upwardly along paths inclined to opposite sides of said cross portions, said peripherally extending marginal portions of said manifold generally paralleling the adjacent side walls of said tank and being spaced inwardly therefrom sufficiently to enable return downward flow of the liquid in said tank along the inner surfaces of the side walls thereof outwardly of the corresponding marginal portions of said manifold, said heater means being disposed in said tank below said baffle, said bottom wall including a sump portion thereof downwardly toward which surrounding portions of said bottom wall are inclined, said sump portion including selectively useable downwardly opening drain means, and said sump portion being centrally disposed relative to the plan area of said bottom wall.

2. The combination of claim 1 wherein said manifold includes an inlet therefor openings into said manifold adjacent one side wall of said tank, said manifold including depending leg means remote from said inlet supportively engaged with said baffle closely inwardly of a side wall of said tank opposite said one side wall.

3. The combination of claim 1 wherein said receptacle includes remote upstanding sides adjacent remote side walls of said tank, said coacting means including upper marginal edges of said remote upstanding side walls and upward extensions carried by said remote upstanding sides of said receptacle having horizontally outwardly projecting abutments supported from upper portions thereof overlying and supported from said upper marginal edges.

4. The combination of claim 1 wherein said baffle includes marginal edges portions closely adjacent and generally paralleling said side walls, said marginal edge portions of said baffle terminating outwardly in downturned flanges abutted against and supported from corresponding marginal edges of said bottom wall.

* * * * *